US006213021B1

(12) United States Patent
Pickett

(10) Patent No.: US 6,213,021 B1
(45) Date of Patent: Apr. 10, 2001

(54) ELECTROMAGNETIC SEA MINE DETONATION SYSTEM

(75) Inventor: David M. Pickett, Clarksburg, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/461,229

(22) Filed: Dec. 16, 1999

(51) Int. Cl.[7] ..... F42D 3/00; F42D 33/06

(52) U.S. Cl. ..... 102/402; 102/401; 102/402; 102/403; 102/417

(58) Field of Search ..... 102/401, 402, 102/403, 417

(56) References Cited

U.S. PATENT DOCUMENTS

| | | | | |
|---|---|---|---|---|
| 2,397,209 | * | 3/1946 | Schaelchlin | 102/403 |
| 2,404,266 | * | 7/1946 | Loughnan | 102/402 |
| 2,838,850 | | 6/1958 | Stephenson et al. . | |
| 2,937,611 | * | 5/1960 | Schaelchlin et al. | 102/417 |
| 3,699,889 | | 10/1972 | Cioccio et al. . | |
| 3,701,331 | * | 10/1972 | Harris, Jr. | 102/402 |
| 3,780,654 | * | 12/1973 | Shimizu et al. | 102/403 |
| 3,826,215 | * | 7/1974 | Dyjak | 102/402 |
| 3,842,770 | * | 10/1974 | Hedbawny et al. | 102/402 |
| 3,880,103 | * | 4/1975 | Talkington | 102/402 |
| 3,906,884 | * | 9/1975 | Gould | 102/402 |
| 3,946,696 | * | 3/1976 | Lubnow | 102/401 |
| 4,020,780 | * | 5/1977 | Shumaker et al. | 102/402 |
| 5,063,850 | * | 11/1991 | Olsson et al. | 102/402 |
| 5,450,805 | | 9/1995 | Beach et al. . | |
| 5,598,152 | * | 1/1997 | Scarzello et al. | 102/402 |

* cited by examiner

*Primary Examiner*—Michael J. Carone
*Assistant Examiner*—Lulit Semunegus
(74) *Attorney, Agent, or Firm*—Jacob Shuster; John Forrest

(57) ABSTRACT

A vehicle is towed underwater by an air traveling helicopter through a towing cable to induce powered rotation of impellers on the vehicle during its underwater travel at a preselected seawater depth. An electrical generator driven by such impeller supplies electrical energy conditioned to produce a sternwise extending signature simulating magnetic field which is effective to detonate a sea mine in the underwater vicinity toward which the underwater vehicle is being towed.

6 Claims, 2 Drawing Sheets

ELECTROMAGNETIC SEA MINE DETONATION SYSTEM

The present invention relates in general to electromagnetic detonation of underwater sea mines.

BACKGROUND OF THE INVENTION

The clearing of sea mines at underwater locations for removal of shipping threats may presently be accomplished by remote controlled generation of a magnetic field causing detonation of the sea mine some distance from the source of electrical energy from which the magnetic field is derived. Usually a gas turbine powers an electrical generator as the foregoing referred to source of electrical energy, carried on a ship or towed water platform. Such mine clearing arrangements are relatively expensive and require a significant amount of maintenance. It is therefore an important object of the present invention to provide a mine clearing system that is less costly and much simpler to operate and maintain.

SUMMARY OF THE INVENTION

In accordance with the present invention a relatively small underwater vehicle carries a source of electromagnetic energy from which a magnetic field is produced and emitted from the vehicle simulating the magnetic signature of a larger surface ship. Such magnetic field is effective to detonate a sea mine at an underwater location in the vicinity of the vehicle to which it is being towed at a preselected sea water depth and speed by an air traveling helicopter connected to the underwater vehicle by a towing cable. Under such travel conditions of the underwater vehicle, powered rotation of impellers mounted thereon is induced to drive an electrical generator as the source of the electromagnetic energy.

BRIEF DESCRIPTION OF DRAWING

A more complete appreciation of the invention and many of its attendant advantages will be readily appreciated as the same becomes better understood by reference to the following detailed description when considered in connection with the accompanying drawing herein.

DETAILED DESCRIPTION OF PREFERRED EMBODIMENT

Figure 1:
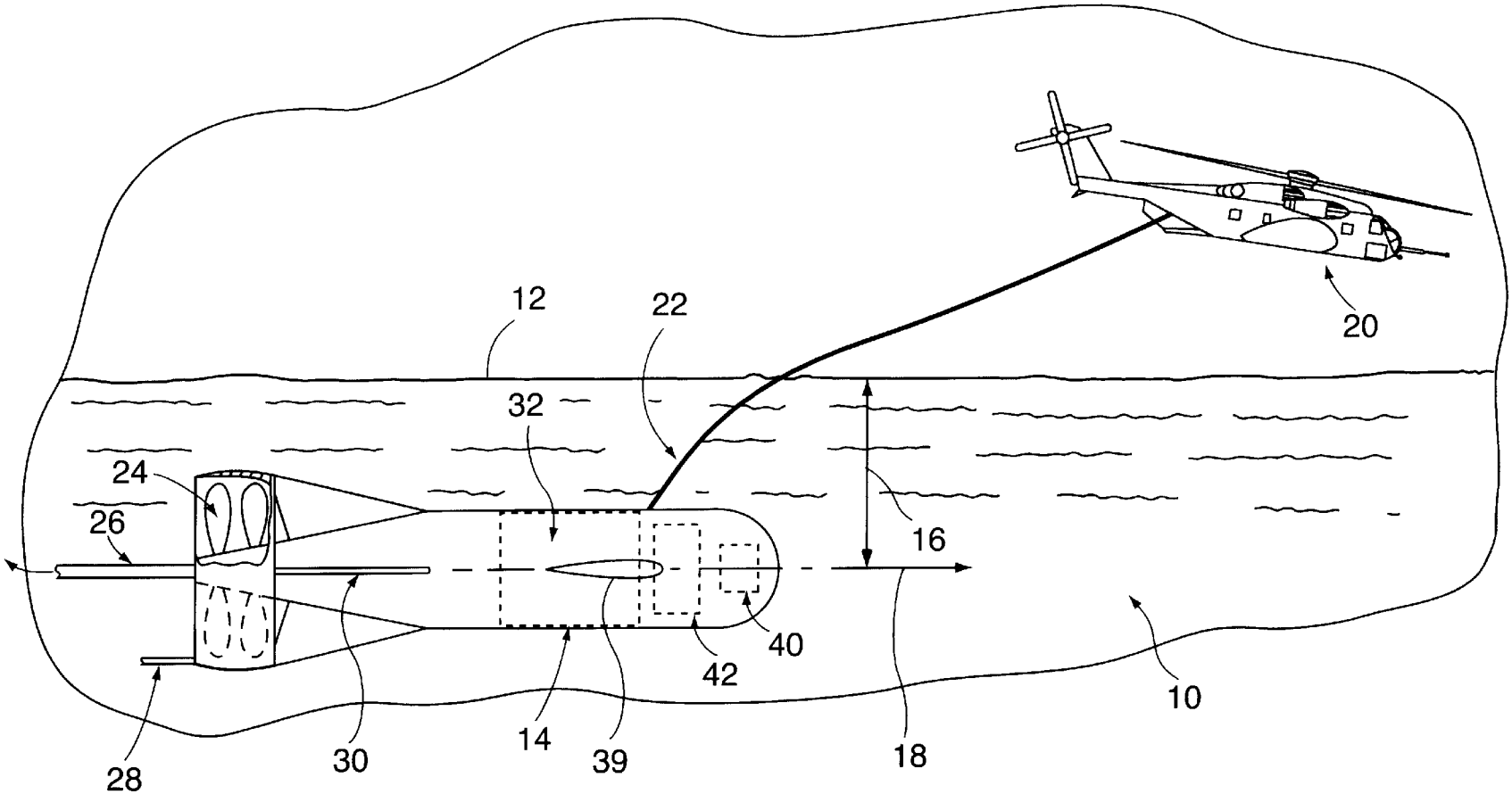
FIG. 1 is a side view illustrating a sea mine detonation system involving an underwater source of electromagnetic energy during helicopter towed travel.

Referring now to the drawing in detail, FIG. 1 illustrates a body of seawater 10 having a surface 12 below which a source of electrical magnetic field generating energy is carried by a vehicle 14 traveling underwater at a preselected depth 16 along a direction denoted by arrow 18. Such underwater travel of the vehicle 14 is induced by the towing force of a helicopter 20, during its air travel above water surface 12. A towing cable 22 accordingly extends from the helicopter 20 to the vehicle 14 through the seawater 10. Pursuant to the present invention, such underwater travel of the vehicle 14 at a speed of approximately 25 knots is exclusively induced by such towing along travel direction 18 toward a suspected underwater location at which a sea mine is to be detonated in order to remove it as a seawater shipping threat.

At the stern end portion of the underwater vehicle 14 as shown in FIG. 1, hydrodynamic impellers 24 are mounted for powered rotation in response to towed travel of the vehicle 14 through the seawater 10. Also extending rearwardly from the stern end of the vehicle into the seawater is a lengthy sweep tail 26 in spaced relation to a shorter electrode 28. A stabilizer fin 30 and a depth controlling wing 39 are also mounted on the vehicle 14 as shown to maintain it at its underwater depth 16 during travel.

Figure 2:
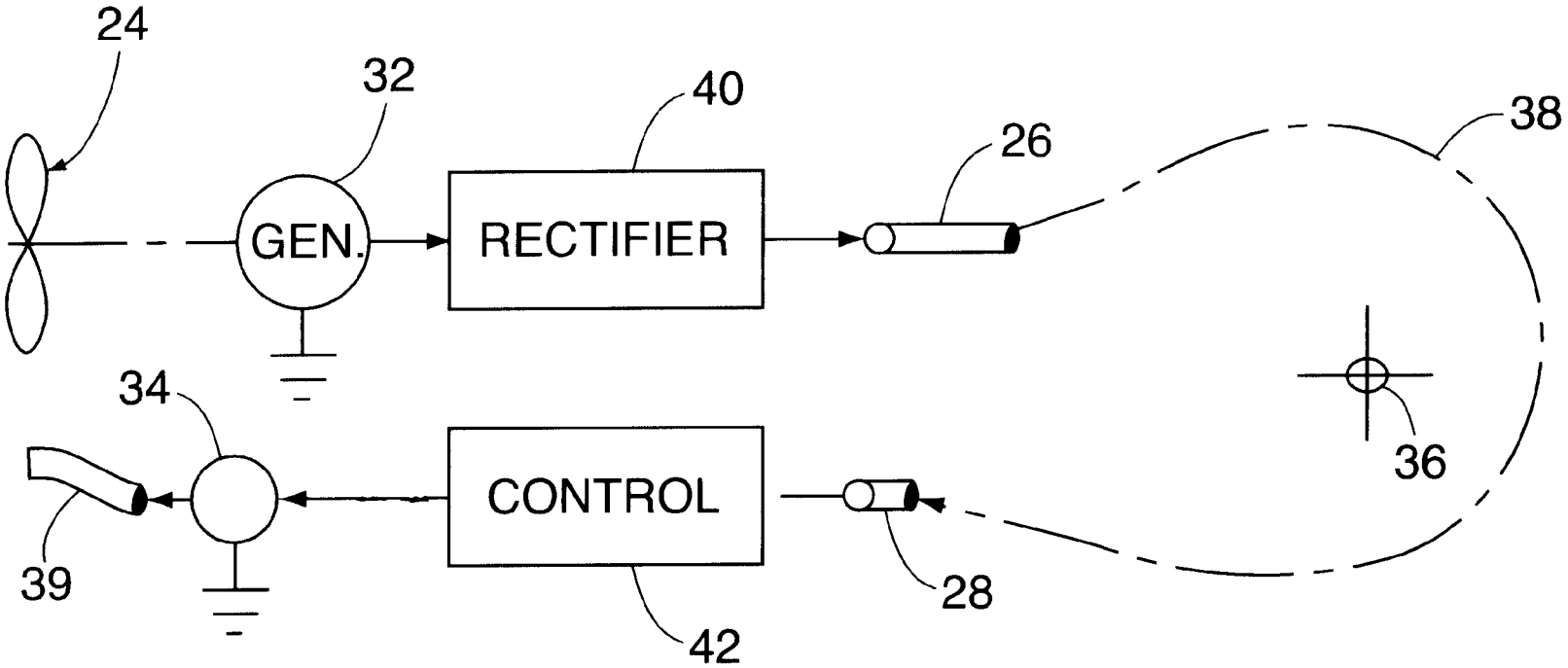
FIG. 2 is a schematic diagram of the detonation system embodied in the apparatus shown in FIG. 1.

As indicated by dotted line in FIG. 1, the vehicle 14 carries an electric generator 32 driven by the impellers 24 as diagrammed in FIG. 2. A drive motor 34 is also provided for regulatory positioning of the wing 39 in order to establish and maintain a proper underwater depth 16 for the vehicle during underwater travel toward a sea mine location 36 as diagrammed in FIG. 2. The sea mine is accordingly detonated when disposed within an underwater magnetic field formed by flow of electrical current along an underwater path 38 from the sweep tail 26 to the electrode 28 as also diagrammed in FIG. 2. The electrical current is derived from the generator 32 and conditioned by rectifier circuitry 40 to simulate the magnetic signature of a surface ship. Such rectifier circuitry 40 is per se well known in the art, heretofore developed for magnetic minesweeping systems. Also control circuitry 42 is provided in association with the rectifier circuitry 40 as diagrammed in FIG. 2 to establish the simulated magnetic signature of the magnetic field during travel of the underwater vehicle 14 at the preselected underwater depth 16, maintained by regulatory control of the electrical current supplied by the control circuitry 42 to the wing drive motor 34. Such drive control circuitry 42 is also per se well known in the art.

Obviously, other modifications and variation of the present invention may be possible in light of the foregoing teachings. It is therefore to be understood that within the scope of the appended claims the invention may be practiced otherwise than as specifically described.

What is claimed is:

1. A system for detonation of a sea mine at an underwater location by a magnetic signature simulating a marine vessel, comprising: an underwater vehicle; towing means connected to said vehicle for imparting underwater travel thereto toward said underwater sea mine; impeller means mounted by the vehicle for powered rotation in response to said travel imparted by the towing means; means carried by the vehicle and driven by said powered rotation of the impeller means for generating electrical energy; and means connected to the electrical energy generating means for establishing a magnetic field corresponding to the magnetic signature simulating the marine vessel to effect said detonation of the sea mine.

2. The system as defined in claim 1, wherein said towing means comprises: a helicopter undergoing air travel above a sea water surface; and a towing cable extending between the helicopter and the underwater vehicle at a preselected depth below the seawater surface during said underwater travel thereof at a speed of approximately 25 knots.

3. The system as defined in claim 2, wherein said signature simulating means includes: a sweep tail projecting sternwise from the underwater vehicle in spaced relation to an electrode; rectifier means connecting the electrical energy generating means to the sweep tail for flow of the electrical energy therefrom through the seawater to the electrode; and control means interconnected between the rectifier means and the electrode for conditioning said flow of the electrical energy to establish said magnetic field within the seawater.

4. The system as defined in claim 3, including lift fin means mounted on the underwater vehicle and connected to the control means for maintaining said preselected depth during said travel of the underwater vehicle.

5. The system as defined in claim 1, wherein said signature simulating means includes: a sweep tail projecting sternwise from the underwater vehicle in spaced relation to an electrode; rectifier means connecting the electrical energy generating means to the sweep tail for flow of the electrical energy therefrom through the seawater to the electrode; and control means interconnected between the rectifier means and the electrode for conditioning said flow of the electrical energy to establish said magnetic field within the seawater.

6. The system as defined in claim 5, including a wing mounted on the underwater vehicle and connected to the control means for maintaining said preselected depth during said travel of the underwater vehicle.

* * * * *